US007758367B2

(12) United States Patent
Siebens et al.

(10) Patent No.: US 7,758,367 B2
(45) Date of Patent: Jul. 20, 2010

(54) HOLLOW RING SEATING INDICATOR

(75) Inventors: Larry Norman Siebens, Asbury, NJ (US); Anthony Reed, Murray, NJ (US); Roger Provencal, Washington, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 109 days.

(21) Appl. No.: 12/008,056

(22) Filed: Jan. 8, 2008

(65) Prior Publication Data

US 2008/0166912 A1 Jul. 10, 2008

Related U.S. Application Data

(60) Provisional application No. 60/879,296, filed on Jan. 8, 2007.

(51) Int. Cl.
*H01R 13/52* (2006.01)

(52) U.S. Cl. ..... 439/271; 439/921

(58) Field of Classification Search ..... 439/271, 439/278, 281, 587

See application file for complete search history.

(56) References Cited

U.S. PATENT DOCUMENTS

| | | | | |
|---|---|---|---|---|
| 3,390,331 | A * | 6/1968 | Brown et al. | 324/122 |
| 3,947,182 | A * | 3/1976 | McCartney | 385/54 |
| 4,793,637 | A | 12/1988 | Laipply et al. | |
| 5,529,513 | A * | 6/1996 | Lee | 439/491 |
| 5,641,306 | A | 6/1997 | Stepniak | |
| 5,795,180 | A | 8/1998 | Siebens | |
| 5,957,712 | A | 9/1999 | Stepniak | |
| 6,168,447 | B1 | 1/2001 | Stepniak et al. | |
| 6,213,799 | B1 | 4/2001 | Jazowski et al. | |
| 6,504,103 | B1 | 1/2003 | Meyer et al. | |
| 6,585,531 | B1 | 7/2003 | Stepniak et al. | |
| 6,830,475 | B2 | 12/2004 | Jazowski et al. | |
| 6,843,685 | B1 | 1/2005 | Borgstrom et al. | |
| 6,939,151 | B2 | 9/2005 | Borgstrom et al. | |
| 6,984,791 | B1 | 1/2006 | Meyer et al. | |
| 7,040,909 | B2 * | 5/2006 | Cairns | 439/271 |
| 7,044,760 | B2 | 5/2006 | Borgstrom et al. | |
| 7,083,450 | B1 | 8/2006 | Hughes | |
| 7,150,098 | B2 | 12/2006 | Borgstrom et al. | |
| 7,216,426 | B2 | 5/2007 | Borgstrom et al. | |
| 7,226,308 | B1 * | 6/2007 | Hanks | 439/427 |
| 7,258,585 | B2 | 8/2007 | Hughes et al. | |
| 7,288,718 | B2 | 10/2007 | Stepniak et al. | |
| 2004/0192121 | A1 * | 9/2004 | Tomasino | 439/784 |
| 2005/0186821 | A1 * | 8/2005 | Franks, Jr. | 439/271 |

OTHER PUBLICATIONS

"Loadbreak Apparatus Connectors 500-26," © Cooper Power Systems, Inc., Jan. 1997.
"Loadbreak Apparatus Connectors 5500-12-1," © Cooper Power Systems, Inc., Aug. 1994.

* cited by examiner

*Primary Examiner*—Tho D Ta
*Assistant Examiner*—Travis Chambers
(74) *Attorney, Agent, or Firm*—Hoffmann & Baron, LLP

(57) ABSTRACT

A seating indicator for loadbreak connectors and deadbreak connectors that includes a substantially round, elastic O-ring having a body and an opening, wherein the O-ring is installed on the transition shoulder portion of a loadbreak bushing insert, and wherein the O-ring extends radially and outwardly from the bushing insert when an elbow connector is properly installed thereon. The O-ring can be hollow so that it will more easily deform and can be made from an elastomeric material in easily viewable colors.

14 Claims, 2 Drawing Sheets

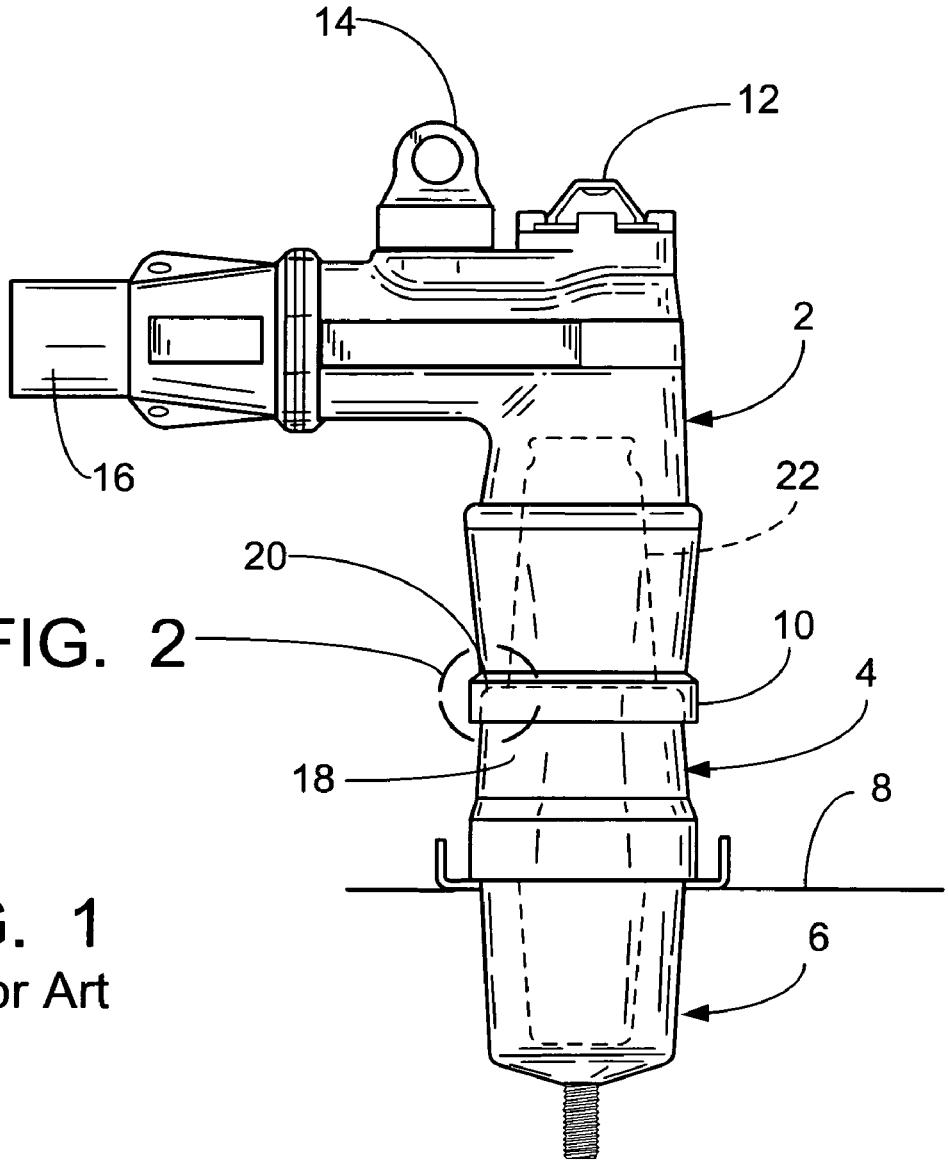
FIG. 2
FIG. 1
Prior Art
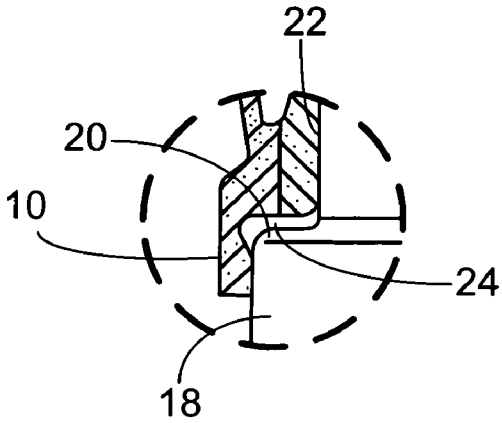
FIG. 2
Prior Art

HOLLOW RING SEATING INDICATOR

This application claims priority from provisional application Ser. No. 60/879,296, filed on Jan. 8, 2007, which is incorporated herein in its entirety.

FIELD OF THE INVENTION

The present invention relates to seating indicators for separable electrical connectors, and in particular, seating indicators for separable electrical connectors such as loadbreak connectors and deadbreak connectors.

BACKGROUND OF INVENTION

Loadbreak connectors used with 15, 25 and 35 KV switchgear generally include a power cable elbow connector having one end adapted for receiving a power cable and another end adapted for receiving a loadbreak bushing insert. The end adapted for receiving the bushing insert generally includes an elbow cuff for providing an interference fit with a molded flange on the bushing insert. This interference fit between the elbow cuff and the bushing insert provides a moisture and dust seal therebetween.

An indicator band may be provided on a portion of the loadbreak bushing insert so that an inspector can quickly visually determine proper assembly of the elbow cuff and the bushing insert. Because of the high voltages, the indicator band has to be visible from a distance of 8 to 10 feet or more. Oftentimes, these indicator bands are not easily viewed and it is difficult to determine if a proper connection is made. Accordingly, there is a need for a seating indicator that can be easily viewed and that provides positive indication that a connection is properly made.

SUMMARY OF THE INVENTION

In accordance with the present invention, an O-ring seating indicator for loadbreak and deadbreak connectors is provided. The seating indicator includes a substantially round, elastic O-ring having a body and an opening, wherein the O-ring is installed on the transition shoulder portion of a loadbreak bushing insert, and wherein the O-ring extends radially and outwardly from the bushing insert when an elbow connector is properly installed thereon.

The O-ring can be hollow so that it will more easily deform and radially extend upwardly from the bushing insert interface when the elbow connector is connected. The O-ring can be made from an elastomeric material, preferably an elastomeric material such as a soft rubber that has high elongation resilience and low temperature flexibility. Preferred materials are natural rubber, butyl, butadiene, nitrile, neoprene, EPDM, silicone, fluorosilicone, ethylene/acrylic, polyisoprene fluoroelastomer, polybutadiene, or Buna-S. The O-ring preferably has a bright color so that it can be easily viewed by a user from a distance, even when viewed from a generally longitudinal direction with respect to the connector. The preferred colors are white, red, green, orange or yellow.

The O-ring has a thickness of from about 0.125 inches to about 0.75 inches, which is measured from the inside diameter of the ring to the outside diameter. Preferably, the thickness is from about 0.25 inches to about 0.50 inches, most preferably about 0.375 inches.

BRIEF DESCRIPTION OF THE FIGURES

The preferred embodiments of the hollow ring seating indicator of the present invention, as well as other objects, features and advantages of this invention, will be apparent from the following detailed description, which is to be read in conjunction with the accompanying drawings wherein:

FIG. 1 is a side elevation view of prior art loadbreak connectors, namely, a power cable elbow, a loadbreak bushing insert and a universal bushing well;

FIG. 2 is an enlarged cross-sectional view of the mating interface between the prior art power cable elbow and loadbreak bushing insert illustrated in FIG. 1;

DETAILED DESCRIPTION OF THE INVENTION

Figure 3:
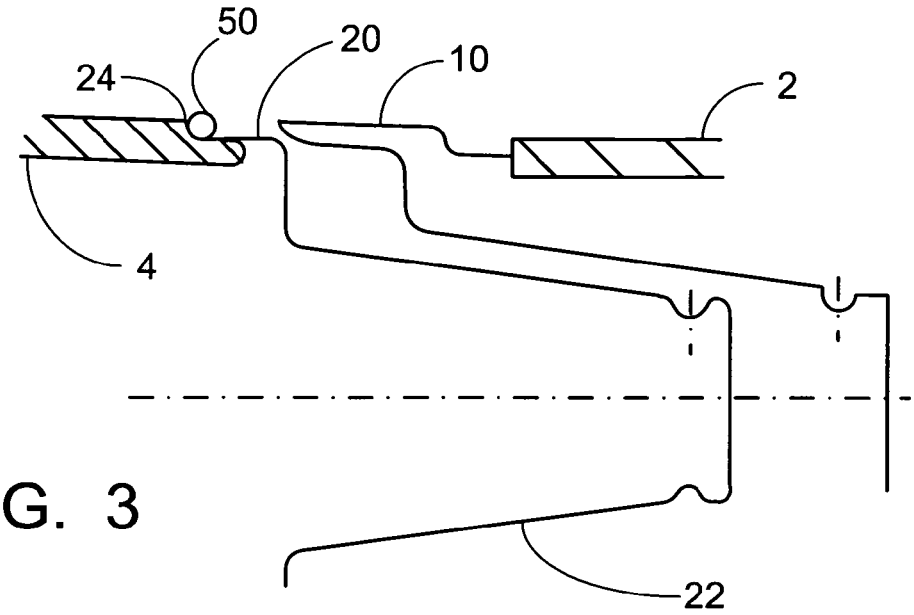
FIG. 3 is an enlarged cross-sectional view of the interface between the power cable elbow connector and a modified loadbreak bushing insert including the hollow O-ring of the present invention prior to mating.

The seating indicators of the present invention are used on load break connectors, in particular, load break connectors as described in U.S. Pat. No. 5,795,180 to Siebens; U.S. Pat. No. 6,168,447 to Stepniak; and U.S. Pat. No. 7,044,760 to Borgstrom, et al., all of which are incorporated herein in their entirety.

The seating indicator is a substantially round, elastic O-ring having a body and an opening defined by the body. The body can be solid or hollow and has a thickness that is defined as the difference between the outside diameter of the ring and the inside diameter of the ring. The O-ring is installed on the transition shoulder portion of a loadbreak bushing insert. When an elbow connector is properly installed on the loadbreak bushing insert, the O-ring is compressed and extends radially and outwardly from the bushing insert, above the outer surfaces of both the loadbreak bushing insert and the elbow connector. This extended portion of the O-ring can be easily viewed by a user and provides positive indication that the elbow connector is properly installed on the loadbreak bushing insert.

In preferred embodiments, the O-ring is hollow so that it compresses more easily when the elbow connector is connected to the bushing insert. The cross-section of the hollow O-ring body is deformed from a substantially round shape to an oblong shape when compressed between the elbow connector and the bushing insert. The compressed O-ring extends radially upwardly from the surface of the elbow connector/bushing insert interface so that it is clearly visible from a distance of at least five feet and preferably from a distance of more than ten feet. The O-ring is also resilient so that, when the elbow connector is disconnected from the bushing insert, the cross-section of the O-ring returns to its original, substantially round shape. If the connection becomes loose, the O-ring retracts from above the surface of the elbow connector/bushing insert interface and indicates to the user that the connection is loose.

The O-ring can be made from an elastomeric material, preferably a soft rubber that has high elongation resilience and low temperature flexibility. Preferred materials are natural rubber, butyl, butadiene, nitrile, neoprene, EPDM, silicone, fluorosilicone, ethylene/acrylic, polyisoprene fluoroelastomer, polybutadiene, or Buna-S. The most preferred elastomeric materials maintain their resilience over long periods of time and are not significantly affected by changes in the ambient temperature. This is important in climates where the temperature varies greatly between summer and winter.

The O-ring preferably has a bright color so that it can be easily viewed by a user from a distance, even when viewed from a generally longitudinal direction with respect to the connector. One consideration in selecting the color of the O-ring is that it contrasts with the colors of the elbow connector and the bushing insert. This ensures maximum visibility. The preferred colors are white, red, green, orange or yellow. However, the invention is not intended to be limited by the selection of the color of the O-ring and the O-ring can have any desired color. shoulder portion of the bushing insert. Accordingly, the inner diameters of different versions of the O-ring correspond to the dimensions of different bushing inserts. These dimensions are published by bushing insert manufacturers and are well know to those skilled in the art. The O-ring has a thickness, measured from the inside diameter of the ring to the outside diameter of the ring, of from about 0.125 inches to about 0.75 inches. Preferably, the thickness of the cross-section of the O-ring is from about 0.25 inches to about 0.50 inches, most preferably about 0.375 inches. The selection of the O-ring thickness depends on the configurations and dimensions of the elbow connector and bushing insert. For example, a thicker O-ring would typically be used in a 35 KV application than would be used in a 15 KV application.

Referring now to the drawings, FIGS. 1 and 2 illustrate prior art loadbreak connectors. In FIG. 1, a power cable elbow connector 2 is illustrated coupled to a loadbreak bushing insert 4, which is seated in a universal bushing well 6. The bushing well 6 is attached to seated on an apparatus face plate 8. The power cable elbow connector 2 includes a first end adapted for receiving a loadbreak bushing insert 4 and having a flange or elbow cuff 10 surrounding the open receiving end thereof. The power cable elbow connector 2 also includes an operating eye 12 for providing "hot-stick" operation (i.e., operating when the connector is under a load) and a test point 14 which is a capacitively coupled terminal used with appropriate voltage sensing devices. A power cable receiving end 16 is provided at the opposite end of the power cable elbow connector 2 and a conductive member extends from the receiving end to the bushing insert receiving end for connection to a probe insertion end of the bushing insert 4.

Referring still to FIGS. 1 and 2, the loadbreak bushing insert 4 includes a mid-section 18 having a larger dimension than the remainder of the bushing insert 4. The mid-section 18 includes a transition shoulder portion 20 between the mid-section and an upper section 22 which is inserted into the power cable elbow connector 2. As more clearly illustrated in FIG. 2, which is an enlarged cross-section of the connector interface, the elbow cuff 10 and side portion of the mid-section 18 for the bushing insert 4 provides a moisture and dust seal through an interference fit therebetween.

Figure 4:
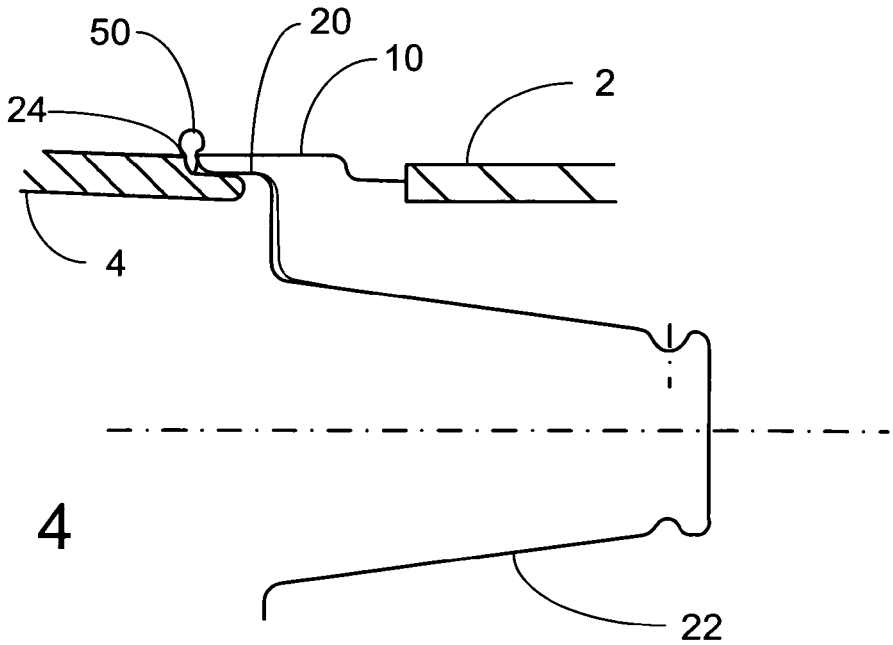
FIG. 4 is an enlarged cross-sectional view of the interface between the power cable elbow connector and a modified loadbreak bushing insert including the hollow O-ring of the present invention after mating.
Figure 5:
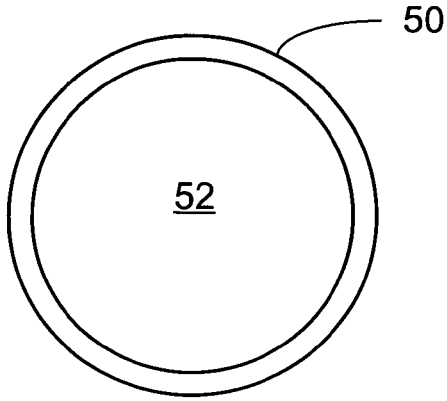
FIG. 5 is a side view of the O-ring of the present invention.

FIG. 3 shows the hollow O-ring 50 installed on or around a raised portion 24 of the mid-section 18 of a loadbreak bushing insert 4. (This is near the transition shoulder portion 20 of the loadbreak bushing insert 4 that is shown in detail in FIG. 2.) The O-ring 50 is substantially round with an opening 52 in the center (see FIG. 5) and, in preferred embodiments, the O-ring 50 is hollow. The O-ring 50 is preferably made from a highly elastic material, such as rubber. The material is also brightly colored, such as yellow or orange, so that the O-ring 50 is highly visible. When the elbow connector 2 is connected to the loadbreak bushing insert 4, the O-ring 50 (preferably hollow in construction) is compressed between the elbow cuff 10 and the transition shoulder portion 20 with its compressed surface forced to radially extend above the interface between the elbow connector 2 and the loadbreak bushing insert 4 (see FIG. 4). This indicates to the user that the elbow connector 2 is properly connected to the loadbreak bushing insert 4.

The hollow O-ring 50 is easily installed on the loadbreak bushing insert 4 by placing it over the upper section 22 of the bushing insert 4 and moving it towards the mid-section 18 and onto the transition shoulder portion 20. The O-ring 50 can have different inner diameters so that it can fit different size bushing inserts 4. Preferably, the O-ring 50 is large enough to fit easily over the transition shoulder portion 20 but does not pass over the raised portion 24. The O-ring 50 is preferably sized so that it fits snugly around the transition shoulder portion 20 of the bushing insert 4 and so that it will remain in place during connection and disconnection operations.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A seating indicator for loadbreak connectors and deadbreak connectors, the indicator comprising a substantially round, elastic O-ring having a body and an opening, wherein the O-ring is installed on a transition shoulder portion of a loadbreak bushing insert, and wherein a compressed surface of the O-ring extends radially above an interface between an elbow connector and the loadbreak bushing insert when the elbow connector is properly installed thereon and the O-ring is compressed between an elbow cuff of the elbow connector and the transition shoulder portion.

2. The seating indicator in accordance with claim 1, wherein the O-ring is white, red, green, orange or yellow.

3. The seating indicator in accordance with claim 1, wherein the O-ring is made from a soft rubber.

4. The seating indicator in accordance with claim 1, wherein the O-ring is made from a natural rubber, butyl, butadiene, nitrile, neoprene, EPDM, silicone, fluorosilicone, ethylene/acrylic, polyisoprene fluoroelastomer, polybutadiene, or Buna-S.

5. The seating indicator in accordance with claim 1, wherein the body of the O-ring has a thickness of from about 0.125 inches to about 0.75 inches.

6. The seating indicator in accordance with claim 1, wherein the body of the O-ring has a thickness of from about 0.25 inches to about 0.50 inches.

7. A seating indicator for loadbreak connectors and deadbreak connectors, the indicator comprising a substantially round, elastic O-ring having a hollow body and an opening, wherein the O-ring is installed on a transition shoulder portion of a loadbreak bushing insert, and wherein a compressed surface of the O-ring extends radially above an interface between an elbow connector and the loadbreak bushing insert when the elbow connector is properly installed thereon and the O-ring is compressed between an elbow cuff of the elbow connector and the transition shoulder portion.

8. The seating indicator for a loadbreak connector in accordance with claim 7, wherein the O-ring is white, red, green, orange or yellow.

9. The seating indicator for a loadbreak connector in accordance with claim 7, wherein the O-ring is made from a soft rubber.

10. The seating indicator for a loadbreak connector in accordance with claim 7, wherein the O-ring is made from natural rubber, butyl, butadiene, nitrile, neoprene, EPDM, silicone, fluorosilicone, ethylene/acrylic, polyisoprene fluoroelastomer, polybutadiene, or Buna-S.

11. The seating indicator for a loadbreak connector in accordance with claim 7, wherein the body of the O-ring has a thickness of from about 0.125 inches to about 0.75 inches.

12. The seating indicator for a loadbreak connector in accordance with claim 7, wherein the body of the O-ring has a thickness of from about 0.25 inches to about 0.50 inches.

13. A seating indicator for loadbreak connectors and deadbreak connectors, the indicator comprising a substantially round, elastic O-ring having a hollow body and an opening, wherein the O-ring is made from natural rubber, butyl, butadiene, nitrile, neoprene, EPDM, silicone, fluorosilicone, ethylene/acrylic, polyisoprene fluoroelastomer, polybutadiene, or Buna-S, wherein the body of the O-ring has a thickness of from about 0.25 inches to about 0.50 inches, wherein the O-ring is installed on a transition shoulder portion of a loadbreak bushing insert, and wherein a compressed surface of the O-ring extends radially above an interface between an elbow connector and the loadbreak bushing insert when the elbow connector is properly installed thereon and the O-ring is compressed between an elbow cuff of the elbow connector and the transition shoulder portion.

14. The seating indicator for a loadbreak connector in accordance with claim 13, wherein the O-ring is white, red, green, orange or yellow.

* * * * *